United States Patent [19]

Barrette et al.

[11] 4,138,770

[45] Feb. 13, 1979

[54] BUNDLING TIE

[75] Inventors: Richard P. Barrette, Lancaster; John B. Glode, Jr.; Richard P. Olsen, both of Acton, Mass.

[73] Assignee: Electro-Ty, Inc., Concord, Mass.

[21] Appl. No.: 790,121

[22] Filed: Apr. 22, 1977

[51] Int. Cl.[2] ..... B65D 63/00

[52] U.S. Cl. ..... 24/16 PB

[58] Field of Search ..... 24/16 PB, 30.5 PB, 73.7, 24/73 PB, 30.5 P, 17 AP, 206 A; 248/68, 74, 74 PB

[56] References Cited

U.S. PATENT DOCUMENTS

| | | | |
|---|---|---|---|
| 3,605,199 | 9/1971 | Eberhardt | 24/16 PB |
| 3,660,869 | 5/1972 | Caveney et al. | 24/16 PB |
| 3,906,593 | 9/1975 | Caveney et al. | 24/16 PB |
| 3,908,233 | 9/1975 | Caveney et al. | 24/16 PB |
| 3,924,299 | 12/1975 | McCormick | 24/16 PB |
| 3,965,538 | 6/1976 | Caveney et al. | 24/16 PB |

FOREIGN PATENT DOCUMENTS

| | | | |
|---|---|---|---|
| 2360992 | 7/1974 | Fed. Rep. of Germany | 24/16 PB |
| 1447628 | 6/1966 | France | 24/16 PB |

*Primary Examiner*—Werner H. Schroeder
*Assistant Examiner*—Moshe I. Cohen
*Attorney, Agent, or Firm*—David E. Brook

[57] ABSTRACT

An improved bundling tie is disclosed of the type having a relatively rigid head and an integrally attached strap having a series of ratchet teeth on its inner surface which engage another series of complementary ratchet teeth on a pawl member positioned within a transverse slot through the head.

8 Claims, 4 Drawing Figures

BUNDLING TIE

BACKGROUND OF THE INVENTION

1. Field of the Invention

This invention is in the field of bundling ties for securing together a plurality of electric wires, cables, tubes, etc.

2. Description of the Prior Art

A wide variety of bunding ties have been fabricated. Many of these are described in the patent literature, among which are the following.

A binding clip having an elongated flexible tongue integrally attached to a rigid head which has an elongated eye containing a pawl flexibly joined to the end of the head outermost with respect to the tongue is described in U.S. Pat. No. 3,486,201 issued to Bourne. The eye in this clip is a straight passage of uniform cross section complementary to that of the tongue. Ratchet teeth on the pawl project into the eye parallel to its major dimension, and these teeth are intended to engage teeth medially positioned upon the tongue. The tongue is wider than the pawl and contains plain marginal portions outside of the teeth; these plain marginal portions abut rigid parts of the head in an attempt to insure effective interengagement of the complementary teeth so that return movement of the tongue is resisted.

Feldberg, in U.S. Pat. No. 3,588,962, describes a plastic bundling strap wherein a pawl is integral with a head and is formed so that it moves relative to the head because only a narrow neck is used to attach the pawl to the head. This facilitates flexing of the pawl during insertion of the strap. One side of this pawl is formed as a surface of a narrow slot, and the pawl swings away from the opposed surface of the slot as the strap is moved into the locking slot of the head. Thus, the pawl flexes back and forth to allow the ratchet teeth of the strap to move past the pawl. However, the opposed surface acts as a stop against free reverse swinging of the pawl to prevent withdrawal of the strap once it has been tightened into position.

Caveney, in U.S. Pat. No. 3,660,869, discloses another tie which has an elongated flexible strap with a row of teeth thereon and a frame integral with one end of the strap. A ledge is provided on an end wall of the head opening and a pawl is pivotally mounted on and integral with the ledge.

Despite the fact that many different cable ties have been heretofore proposed, none has proven entirely satisfactory to date. This is partially evidenced, for example, by the large number of patents directed to new cable tie designs, including many recently issued patents. While it may not be initially apparent why prior ties have not been satisfactory, a more detailed analysis indicates that many of the design features required for effective locking, particularly for both large and small bundle diameters, are contrary to those design features necessary for efficient fabrication of the ties.

SUMMARY OF THE INVENTION

This invention relates to an improved bundling tie having a unique design which provides features required for effective locking as well as features required for efficient fabrication.

The bundling tie of this invention is an integral unit having a relatively rigid head and a flexible strap extending from the head and having a row of ratchet teeth on its inner surface. A locking slot, transverse to the strap, extends through the head and contains a pawl member having ratchet teeth complementary to those on the strap. This transverse slot is formed between first and second end walls and two side walls of the head. The end walls and side walls have inner surfaces which are generally planar. The outer surfaces of the end walls have a slight slope, or draft angle, and the inner surface of the second or outermost end wall has reverse draft angles. These draft angles facilitate ejection of the molded tie after a molding cycle has been completed.

The flexible strap is integrally attached to the base of the outer surface of the first end wall and a pawl member is attached to the base of the inner surface of the same wall member. This provides, of course, offsetting forces when the tie is locked.

The pawl is attached through a neck having sides which each make an angle with the first wall of between 35° and 40°. This angle has been found to be essential if good mold release and effective locking, at both large and small bundle ties, is to be achieved. This pawl neck extends upwardly to an enlarged portion which has ratchet teeth complementary to those on the strap. An opening for passage of the strap is thus defined within the head between the second, or outermost, end wall and the pawl teeth. This opening has a width less than the thickness of the strap which insures that the complementary ratchet teeth engage in an interlocking relationship as the strap is drawn through the transverse slot and tightened around a bundle to be secured.

The improved bundling tie of this invention provides a superior balance of properties because of its unique design over those ties heretofore known. For example, the inside surface on the outermost end wall of the head, coupled with the position and design of the pawl, allows the strap to be inserted without deflecting the pawl to a great extent. This minimizes the risk of introducing permanent stress damage to the neck of the pawl. It also minimizes the distance which the pawl has to travel in order to lock the strap after it has been inserted through the locking slot and tightened around a bundle; this is particularly important with small diameter bundles since even a small amount of slippage during locking becomes very significant in this case.

Attaching the pawl to the base of the same end wall to which the strap is attached provides additional advantages. One of these is the ability to place the ratchet teeth on the inner surface of the strap which provides outstanding frictional engagement when the strap is wrapped around a bundle. This arrangement also results in a natural counterbalancing of forces at the base of this end wall.

Further, the design of the pawl neck provides sufficient strength so that the pawl is not sheared or otherwise damaged during molding as well as providing the pawl strength required for effective locking. This design allows the pawl to function with spring action rather than hinge action.

The draft angles which have been provided, particularly the reverse draft angles on the inner surface of the second head wall member, serve to improve molding efficiency. Not only is ejection of the molded tie facilitated by these draft angles, but the liklihood of damage to the molded elements, particularly the pawl teeth, is greatly reduced during ejection because of the presence of these angles.

In brief, the unique tie design described herein provides effective locking and yet allows efficient and convenient fabrication of ties.

DESCRIPTION OF PREFERRED EMBODIMENTS

Figure 1:
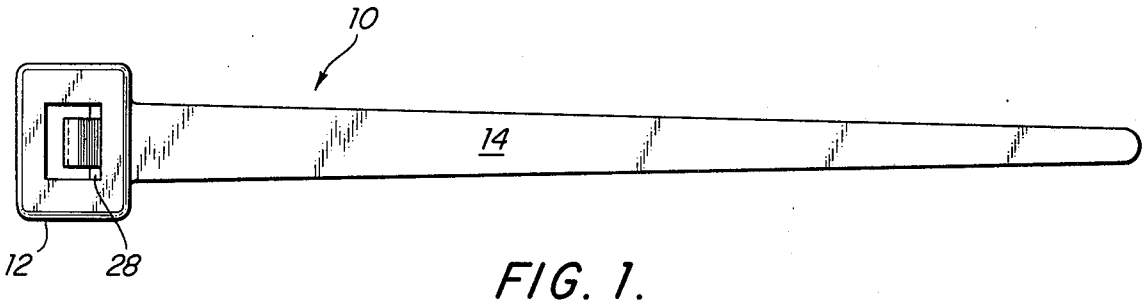
FIG. 1 is a plan view illustrating the top of an improved bundling tie according to this invention.
Figure 2:
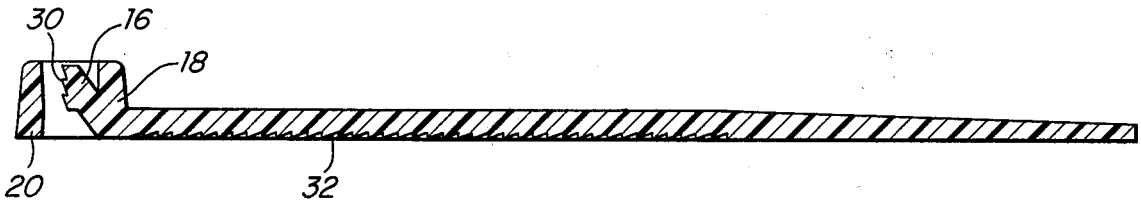
FIG. 2 is a side elevation view of the same bundling tie.
Figure 3:
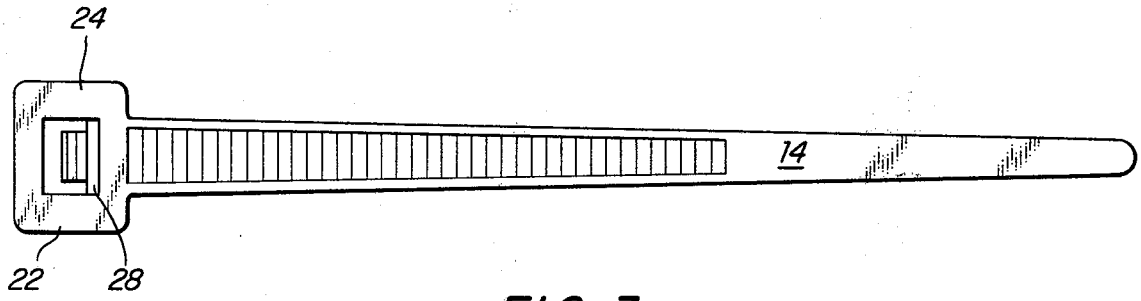
FIG. 3 is a bottom view of the same bundling tie.

The invention can be further described with reference to FIGS. 1–4 in more detail.

Therein, a bundling tie 10 is illustrated as an integral unit comprising a relatively rigid head 12, relatively flexible strap 14, and pawl member 16. Since these elements are typically molded from the same material, the relative degrees of rigidity and flexibility for head 12 and strap 16, respectively, are usually gained by molding thicker wall portions for head 12 than for strap 14. Although bundle tie 10 may be molded from many plastics, one suitable and preferred material is rigid nylon.

Pawl member 16 is located within a slot transverse to strap 14 and extending through head 12. The transverse slot is formed between first or innermost end wall 18, second or outermost end wall 20, and side walls 22 and 24. End walls 18 and 20 and side walls 22 and 24 have inner surfaces which are generally planar, and the inner surfaces of side walls 22 and 24 are substantially parallel.

Figure 4:
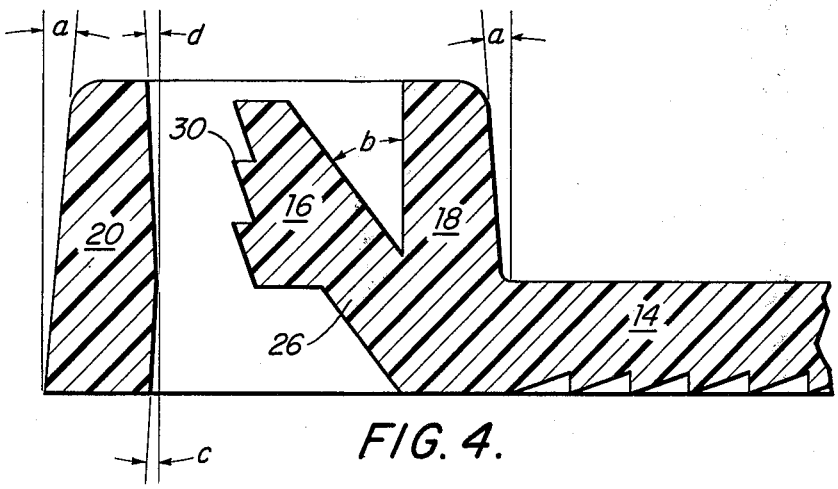
FIG. 4 is an exploded, cut-away, partial side view of the head of a bundling tie of this invention.

The outer surfaces of end walls 18 and 20 are slightly sloped as can be seen clearly in FIG. 4. Angle a may be referred to as a draft angle on these outer walls and provides an increased molding efficiency as described above. The specific angle is chosen to be a good balance between mold release and the wall strength needed for effective locking of strap 14. A typical draft angle a might be about 5°. Typically, side walls 22 and 24 would also have draft angles such as angle a.

Pawl member 16 is attached at the base of the inner surface of first end wall 18 by neck portion 26. Neck portion 26, while thinner than the upper portion of pawl 16, has a thickness sufficient to provide adequate strength to pawl member 16 to resist shearing during mold release and to provide effective locking.

Neck 26 also has a widened shoulder 28 where it attaches to first end wall 18 which provides additional strength without interfering with insertion of strap 14. The design of neck 26, including shoulder 28, insures that pawl 16 operates as a spring rather than as a hinge during insertion and securing of strap 14.

As shown, the upper and lower surfaces of neck 26 are substantially parallel. This is important to avoid the development of an inordinate amount of stress at a point location on neck 27.

Neck 26 makes an angle b with the inner surface of first end wall 18, and angle b is crucial to proper operation of bundling tie 10. If angle b is too large, it has been found that pawl 16 can be deflected too much which decreases locking effectiveness, particularly for small bundle diameters. On the other hand, if angle b is too small, more difficult mold release is encountered. Thus, angle b is chosen as an optimum balance between effective locking and ease of release after molding.

The precise number of degrees for angle b will vary with several factors, including the size of the bundling tie. In general, however, it has been found that angle b is sufficient for any size tie, if it is within the range of from about 5.5/L to about 6.5/L, where L is equal to the length of head 12, i.e., the distance between the outer surfaces of first end wall 18 and second end wall 20 measured at the top of the head. In one embodiment of a 3" tie as described herein, this formula produces a range for angle b of between 35° and 42°, whereas in one embodiment of a 6" tie the range for angle b is from 23° to 27°.

Neck 26 extends upwardly from the base of first end wall 18 to a larger upper portion of pawl 16 having ratchet teeth 30 thereon. Ratchet teeth 30 are complementary to ratchet teeth 32 which are formed on the lower or inner surface of strap 14. There is a wide latitude of tooth sizes and pitch, and these will vary with certain parameters including the size of the bundle tie 10. A typical set of ratchet teeth for a 3" tie would have a tooth depth of about 0.0075" and a pitch of 20°. It is preferred to produce teeth with the sharpest edges possible during molding, so that the most effective locking possible is obtained.

Thus, when strap 14 is wrapped around a bundle and inserted through the transverse slot of head 12, the complementary sets of ratchet teeth, 30 and 32, engage each other in an interlocking relationship. When strap 14 has been pulled tightly around the bundle, the complementary sets of ratchet teeth prevent it from slipping backward to any significant extent. After strap 14 has been locked into position, its terminal end may be clipped off so that no portion of strap 14 extends beyond the upper boundaries of head 12. This might be done, for example, for security purposes.

Another unique feature of the bundling ties described herein is the reverse draft angles c and d which can be seen most clearly in FIG. 4. These allow bundling tie 10 to be molded with three mold inserts which can be easily separated after molding without damaging molded elements, particularly the pawl teeth. Angles c and d are typically in the range of about 1°–3°, which is sufficient for good mold release and yet not large enough to interfere with effective locking. Angles c and d both originate at a point on the inner surface of end wall 20 which is adjacent the bottom edge of the lowest pawl tooth.

Those skilled in the art will recognize, or be able to ascertain using no more than routine experimentation, many equivalents to the specific components, elements, structures, materials, etc., which have been specifically enumerated herein. All such equivalents are within the scope of this invention and are intended to be covered by the following claims.

What is claimed is:

1. In a bundling tie comprising a relatively rigid head and a relatively flexible strap integrally attached thereto and having ratchet teeth thereon, said head having a slot therethrough transverse to the strap and containing a pawl member having ratchet teeth complementary to those on said strap, the complementary ratchet teeth being capable of engaging in an interlocking relationship as the flexible strap is drawn through the transverse slot:

the improvement wherein the transverse slot is formed between first and second end walls and two side walls of said head, the inner surfaces of said side walls being generally planar and substantially parallel, wherein said strap is attached at the base of the outer surface of the first end wall, wherein said pawl member is attached at the base of the inner surface of said first end wall by a neck portion making an angle b with the first end wall of from about 23° to about 42°, said neck having upper and lower surfaces which are substantially parallel and having a thickness sufficient to provide pawl strength and effective locking, and said neck having a widened shoulder where it is attached to the first end wall of said head, and wherein the neck portion of said pawl extends upwardly to an enlarged portion having the complementary ratchet teeth thereon and defining an opening between the second end wall and the pawl having a width of less than the thickness of said strap.

2. The improvement of claim 1 wherein reverse draft angles c and d are provided on the inner surface of said second end wall, said reverse draft angles originating at a point on the inner surface of said end wall adjacent to the bottom edge of the lowest pawl tooth and each of said reverse draft angles being between about 1° and about 3°.

3. The improvement of claim 2 wherein angle b is between about 35° and about 42°.

4. The improvement of claim 3 wherein the ratchet teeth on said flexible strap are present on its inner surface.

5. The improvement of claim 4 wherein the upper portion of the pawl extends to a position slightly below the top of the pawl head.

6. The improvement of claim 5 wherein the neck of the pawl makes an angle of about 38° with the first end wall of the head.

7. The improvement of claim 6 wherein the outer surfaces of the head walls have draft angles of about 5°.

8. The improvement of claim 7 wherein the bundling tie is formed from nylon.

* * * * *